US005704810A

United States Patent [19]

Shimasaki

[11] Patent Number: 5,704,810

[45] Date of Patent: Jan. 6, 1998

[54] ELECTRICAL CONNECTOR WITH FILTER

[75] Inventor: Hisayoshi Shimasaki, Toyama, Japan

[73] Assignee: Nippon Carbide Kogyo Kabushiki Kaisha, Tokyo, Japan

[21] Appl. No.: 785,615

[22] Filed: Jan. 17, 1997

Related U.S. Application Data

[63] Continuation of Ser. No. 530,231, filed as PCT/JP95/00125, Jan. 31, 1995, abandoned.

[30] Foreign Application Priority Data

Feb. 3, 1994 [JP] Japan ..... 6-03084
Mar. 11, 1994 [JP] Japan ..... 6-066504

[51] Int. Cl.[6] ..... H01R 13/66

[52] U.S. Cl. ..... 439/620

[58] Field of Search ..... 439/620, 744, 439/745, 746, 607, 608

[56] References Cited

U.S. PATENT DOCUMENTS

| | | | |
|---|---|---|---|
| 4,371,226 | 2/1983 | Brancaleone | 439/608 |
| 4,657,323 | 4/1987 | Erbe | 439/620 |
| 4,682,129 | 7/1987 | Bakermans et al. | 439/607 |
| 4,726,638 | 2/1988 | Farrar et al. | 439/620 |
| 4,729,743 | 3/1988 | Farrar et al. | 439/620 |
| 4,767,732 | 8/1988 | Furukawa et al. | 501/137 |
| 5,032,809 | 7/1991 | Chambers et al. | 439/608 |
| 5,242,318 | 9/1993 | Plass | 439/620 |
| 5,340,334 | 8/1994 | Nguyen | 439/620 |
| 5,344,342 | 9/1994 | Briones | 439/620 |
| 5,461,014 | 10/1995 | Chu et al. | 501/135 |

FOREIGN PATENT DOCUMENTS

| | | | |
|---|---|---|---|
| 3004267 | 8/1981 | Germany | 439/745 |
| 63-239900 | 10/1988 | Japan . | |
| 4-129185 | 4/1992 | Japan . | |

*Primary Examiner*—Neil Abrams
*Assistant Examiner*—T. C. Patel
*Attorney, Agent, or Firm*—Young & Thompson

[57] ABSTRACT

The electrical connector with a filter according to the present invention comprises a shield frame, a filter unit having holes, contact elements to be inserted respectively into the holes, and a leaf spring interposed between the shield frame and the filter unit, the filter unit having a filter function corresponding to the holes, and a ground electrode; the ground electrode and the shield frame being electrically connected by the leaf spring; and the filter unit and the shield frame being mechanically secured and held by the leaf spring. Also, the electrical connector with a filter according to the present invention comprises a shield frame, a filter unit having holes, contact elements to be inserted respectively into the holes and each having a stopper, a fixture for allowing the contact elements to be inserted, a leaf spring interposed between the shield frame and the filter unit, and a body, the filter unit having a filter function corresponding to the holes and a ground electrode; the ground electrode and the shield frame being electrically connected by the leaf spring; the filter unit and the shield frame being mechanically secured and held by the leaf spring; and the contact elements being pressed against the filter unit by the fixture through the stoppers.

3 Claims, 5 Drawing Sheets

ELECTRICAL CONNECTOR WITH FILTER

This application is a continuation of application Ser. No. 08/530,231, filed as PCT/JP95/00125 Jan. 31, 1995, now abandoned.

FIELD OF THE INVENTION

This invention relates to an electrical connector equipped with a filter.

BACKGROUND OF THE INVENTION

In recent years, with the progress in performance and processing speed of electric devices, it has been demanded to suppress and/or attenuate interference signals and noise signals. To this end, various types of electrical connectors with a filter has been proposed (Japanese Patent Application Laid-Open 59-184478, Japanese Patent Application Laid-Open 59-184479, Japanese Patent Application Laid-Open 62-180973 and Japanese Patent Application Laid-Open 63-239900).

The above prior art proposes to provide a structure in which a shield frame and a filter unit are electrically connected by means of solder and mechanically held.

In the above-mentioned structure, the shield frame and the filter unit are electrically connected and mechanically held by means of solder. First, the cost required for soldering is comparatively high. Secondly, the filter unit is susceptible to crack by heat generated during soldering. Also, there is a possibility that solder leach occurs. Moreover, residue of flux used during soldering adversely affects component members of the electrical connector with a filter with the passage of time. Furthermore, since the soldered parts are rigid, they are not resistant to expansion and shrinkage due to temperature cycle.

SUMMARY OF THE INVENTION

It is, therefore, an object of the present invention to provide an electrical connector with a filter which can solve the above problems.

The present invention has achieved the above object by providing an electrical connector with a filter comprising a shield frame, a filter unit having holes, contact elements to be inserted respectively into the holes, and a leaf spring interposed between the shield frame and the filter unit, the filter unit having a filter function corresponding to the holes, and a ground electrode;

the ground electrode and the shield frame being electrically connected by the leaf spring; and the filter unit and the shield frame being mechanically secured and held by the leaf spring (hereinafter referred to as the "first invention").

Also, the present invention has achieved the above object by providing an electrical connector with a filter comprising a shield frame, a filter unit having holes, contact elements to be inserted respectively into the holes and each having a stopper, a fixture for allowing the contact elements to be inserted, a leaf spring interposed between the shield frame and the filter unit, and a body, the filter unit having a filter function corresponding to the holes and a ground electrode;

the ground electrode and the shield frame being electrically connected by the leaf spring;

the filter unit and the shield frame being mechanically secured and held by the leaf spring; and the contact elements being pressed against the filter unit by the fixture through the stoppers (hereinafter referred to as the "second invention").

It should be noted that the terms "the present invention" as used herein includes both the first and the second inventions.

The electrical connector with a filter of the present invention can be preferably used for electronic devices, electronic equipment, etc. For example, it can be desirably used for communication equipments, electronic devices for automobiles, peripheral equipments of computers, vending machines, ticket vending machines, various electronic game devices including "Pachinko" (Japanese pinball) machines and amusement game machines.

DESCRIPTION OF THE PREFERRED EMBODIMENTS

The electrical connector equipped with a filter according to the first invention will be described hereinafter with reference to the drawings illustrating its preferred embodiment.

Figure 1:
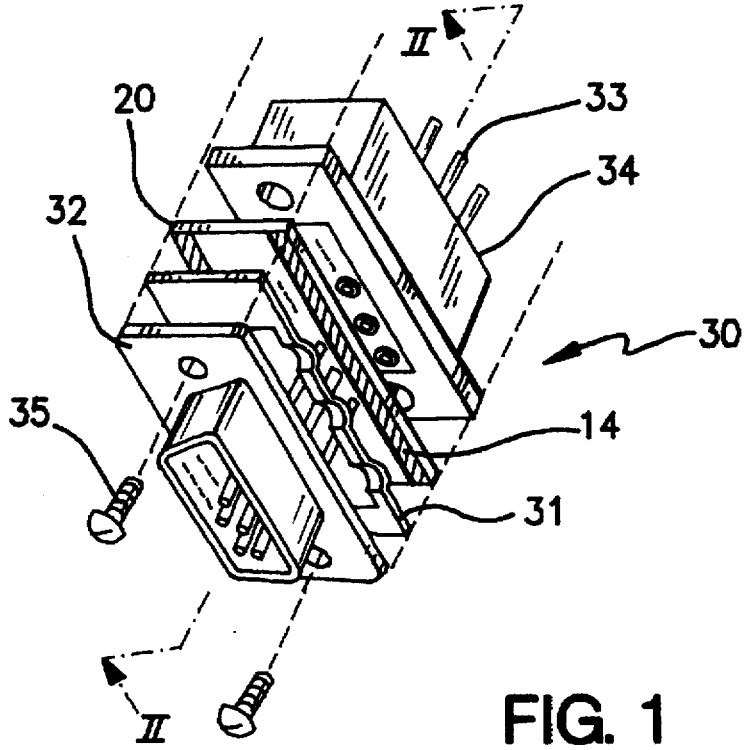
FIG. 1 is an exploded perspective view showing a preferred embodiment of the electrical connector with a filter according to the first invention.
Figure 2:
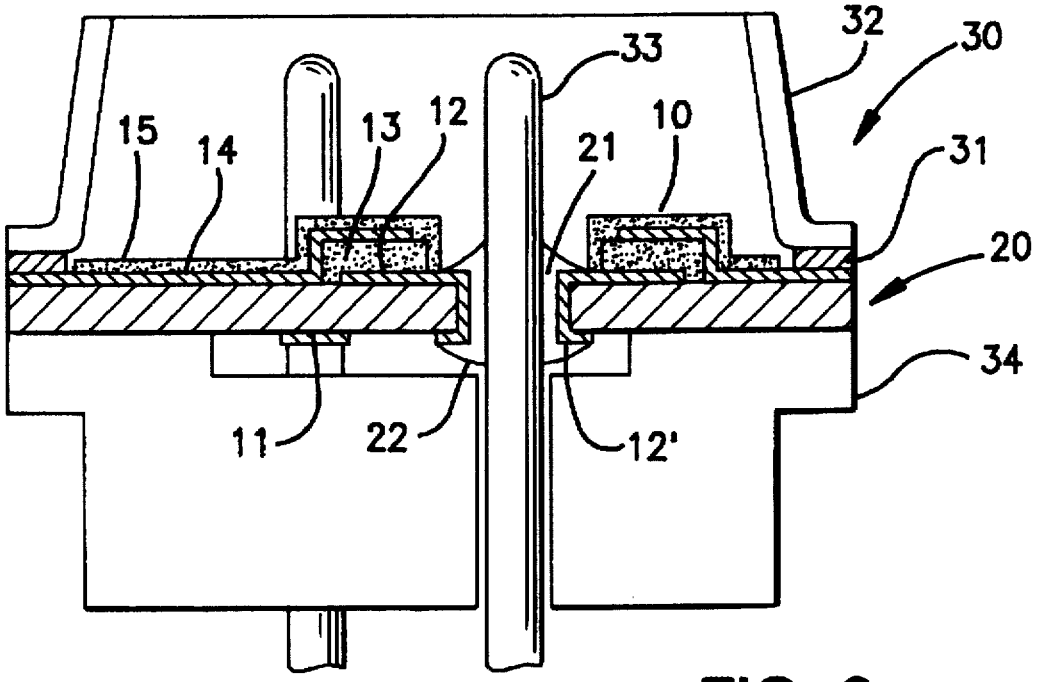
FIG. 2 is a sectional view taken along line II—II of FIG. 1 and viewed in a direction as indicated by arrows.
Figure 3:
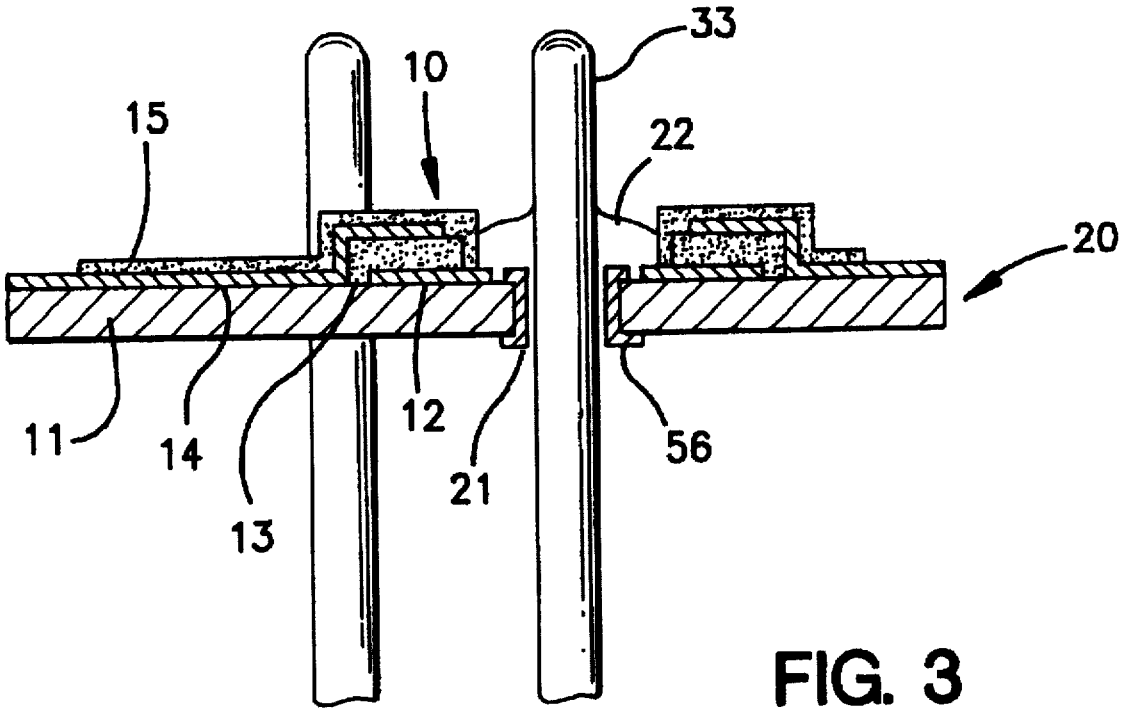
FIG. 3 is a sectional view showing another embodiment of a filter unit.

FIG. 1 is an exploded perspective view showing a preferred embodiment of the electrical connector with a filter according to the first invention, FIG. 2 is a sectional view taken on line II—II of FIG. 1 and viewed in a direction as indicated by arrows, and FIG. 3 is a sectional view showing another embodiment of a filter unit.

As shown in FIGS. 1 and 2, the electrical connector with a filter according to the first invention comprises a shield frame 32, a filter unit 20 having holes 21, contact elements 33 to be inserted respectively into the holes 21, and a leaf spring 31 interposed between the shield frame 32 and the filter unit 20. The shield frame 32, the leaf spring 31 and the filter unit 20 are firmly secured by a set pin 35. If necessary, a body 34 may be preferably secured firmly with these members in such a manner that the body 34 accommodates the filter unit. The leaf spring 31 is so contoured as to contact a ground electrode 14 formed on the filter unit 20 and the shield frame 32, thereby electrically connecting the ground electrode 14 with the shield frame 32. Further, the leaf spring 31 mechanically secures and holds the filter unit 20 and the shield frame 32 (and, the body 34, if necessary).

The filter unit 20 has a single or a plurality of holes 21 formed in an alumina substrate 11 so that the contact elements 33 can be inserted therein respectively. The filter unit 20 further has a filter function corresponding to the holes 21 and the ground electrode. The term "filter function corresponding to the holes" as used herein refers to a filter function associated with the respective contact elements 33 inserted into the holes. In FIGS. 2 and 3, the filter function 10 is formed on the periphery of each of the holes 21, but it should be noted that the filter function 10 is not necessary to be formed on the periphery of all the holes 21. Also, the filter function 10 is not necessary to be formed in the periphery of the hole 21. Alternatively, it may be formed, for example, in an area adjacent to the hole 21.

The number of holes 21 provided is generally equal to that of the contact elements 33 provided.

The filter function 10 preferably comprises a conductor, a dielectric substance and/or a ferrite. Further, where a high electrostatic capacity is required, it is preferred that a multi-layer printed ceramic condenser is used as the filter function 10. Where the filter function 10 is composed of a conductor and a dielectric substance, the filter function 10 comprises, as shown in FIG. 2, a lower electrode 12, an upper electrode 14, a dielectric layer 13 interposed between the lower electrode 12 and the upper electrode 14, and a protective glass layer 15 covering the upper electrode 14 and the dielectric layer 13. In the filter unit 20 shown in FIG. 2, the upper electrode 14 also serves as the ground electrode.

The filter function 10 shown in FIG. 3 comprises a conductor, a dielectric substance and a ferrite. That is, in the filter function 10 shown in FIG. 3, the ferrite 56 is provided on the periphery of the hole 21, the lower electrode 12 is provided in such a manner as to surround the ferrite 56, and there are further provided the upper electrode 14, the dielectric layer 13 interposed between the lower electrode 12 and the upper electrode 14, and the protective glass layer 15 covering the upper electrode 14 and the dielectric layer 13. In the filter unit shown in FIG. 3, the upper electrode 14 also serves as the ground electrode.

It should be noted, however, that the filter unit 20 is not limited to the above-mentioned embodiments, and the filter unit 20 can be appropriately varied in material, contour, construction, method of manufacture, etc.

The filter unit 20 is preferably manufactured by means of printing technique and particularly preferably manufactured by thick-film printing technique.

The filter function 10 is not limited to the embodiment in which it is provided only at a single surface of the alumina substrate 11. Alternatively, it may be provided at both surfaces of the alumina substrate 11 or it may be alternately provided at the upper and the lower surfaces thereof.

Where the filter function 10 is configurated as in the embodiments as shown in FIGS. 2 and 3, the upper electrode 14 may be used as the ground electrode and the lower electrode 12 may be electrically connected to the contact element 33. Alternatively, the lower electrode 12 may be used as the ground electrode and the upper electrode 14 may be electrically connected to the contact element 33. Further, in a filter function in the filter unit 20, the upper electrode 14 may be used as the ground electrode and the lower electrode 12 may be electrically connected to the contact elements 33, and in another filter function, the lower electrode 12 may be used as the ground electrode and the upper electrode 14 may be electrically connected to the contact elements 33.

The leaf spring 31 may be of a material and/or construction having spring properties or elastic properties and electrically conductive properties. For example, a plate, a spring, a wire, a rubber, a resin, or the like may be used as the leaf spring 31.

The alumina substrate 11 is not particularly limited as a substrate, and other materials may be used as far as they have electrical insulation properties.

The dielectric substance is not particularly limited. It is preferred that the dielectric substance is of a lead perovskite structure, and particularly preferred that the dielectric substance comprises at least one compound selected from the group consisting of $Pb(Mg_{1/3}Nb_{2/3})O_3$, $Pb(Zn_{1/3}Nb_{2/3})O_3$, $PbTiO_3$ and $Bi_2O_3$.

The contact elements 33 are inserted respectively into the holes 21 formed in the filter unit 20 and secured by the fixing means. The fixing means is not particularly limited. For example, the contact elements 33 may be secured by soldering from a single or both surfaces of the filter unit 20. When the contact elements 33 are secured to the filter unit 20 by soldering, a crack may not occur if the filter unit 20 is pre-heated prior to soldering. After soldering, if ultrasonic cleaning is effected, no residue of flux may be remained and no adverse effect caused by a change with time may occur.

For assembling the filter unit 20 having the contact elements 33 inserted and secured therein into the shield frame 32 (and the body 34, if necessary), the leaf spring 31 is held between the shield frame 32 and the filter unit 20. With this configuration, the ground electrode 14 of the filter unit 20 and the shield frame 32 can be electrically connected to each other, and the filter unit 20 and the shield frame 32 can be mechanically held without soldering. The number of the leaf spring 31 is not limited to one and a plurality of leaf springs may be employed in accordance with necessity. The electrical connector with a filter 30 thus assembled has advantages that no cracks occur which would otherwise occur due to heat produced during soldering, that no solder leach occurs, and that no residue of flux for soldering is remained since the shield frame 32 and the filter unit 20 are not soldered. Further, the connector 30 is resistant to temperature cycle.

The order of assembling the contact elements 33, the filter unit 20, the body 34, the shield frame 32, the leaf spring 31 and set pins 35 are varied according to the contour of the connector, and therefore not particularly limited.

Next, the electrical connector equipped with a filter according to the second invention will be described in detail with reference to the preferred embodiments thereof as illustrated in the drawings.

Figure 4:
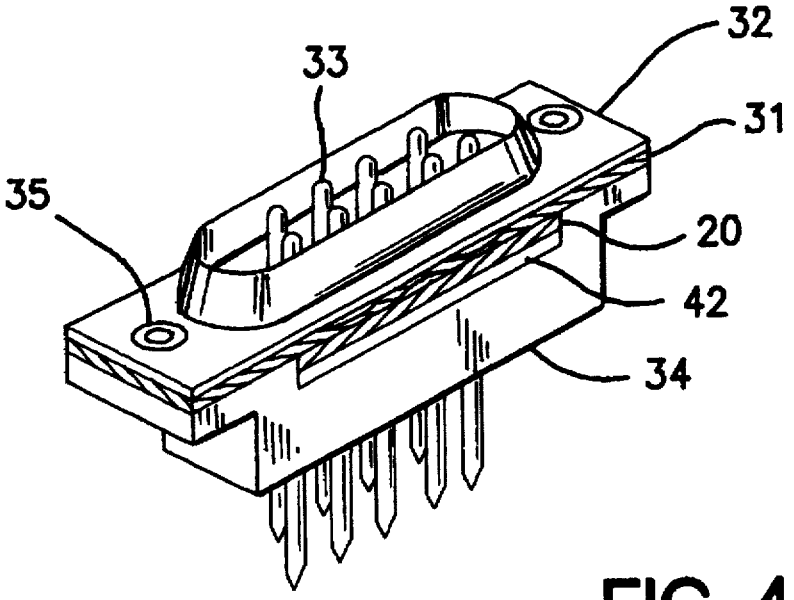
FIG. 4 is a perspective view showing a preferred embodiment of the electrical connector with a filter according to the second invention.
Figure 5:
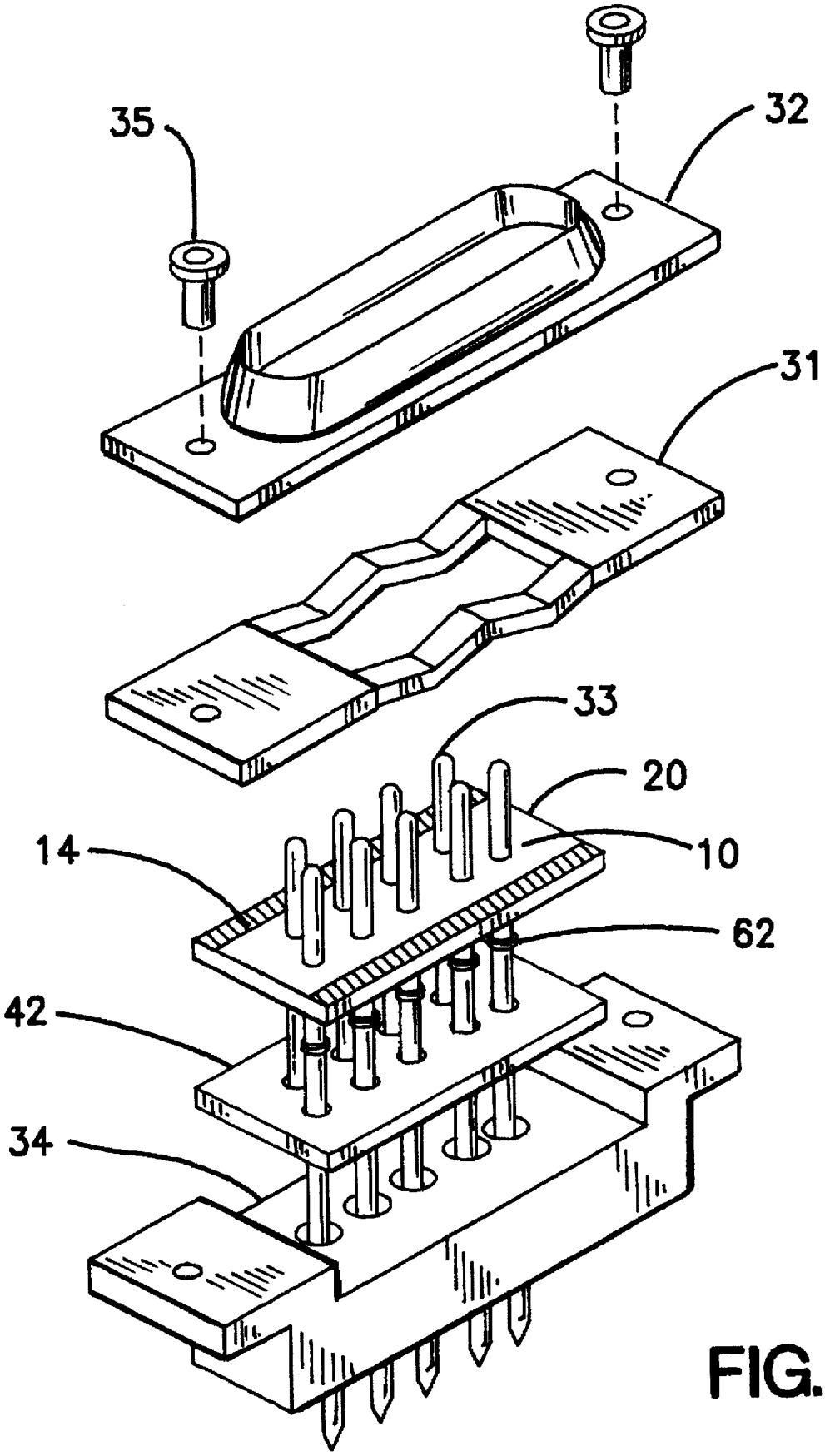
FIG. 5 is an exploded perspective view of the electrical connector with a filter shown in FIG. 4.
Figure 6:
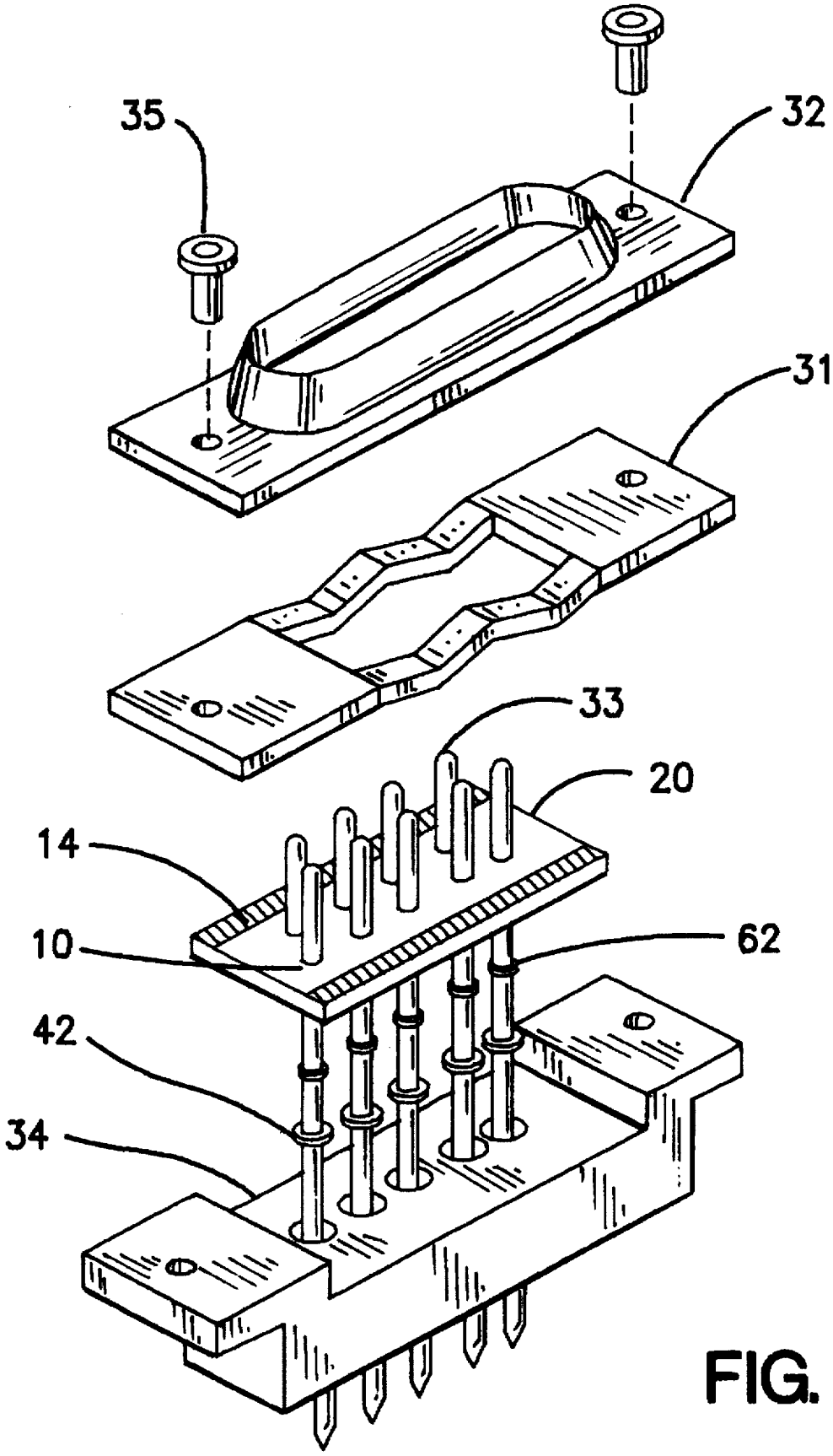
FIG. 6 is an exploded perspective view showing another preferred embodiment of the electrical connector with a filter according to the second invention.
Figure 7:
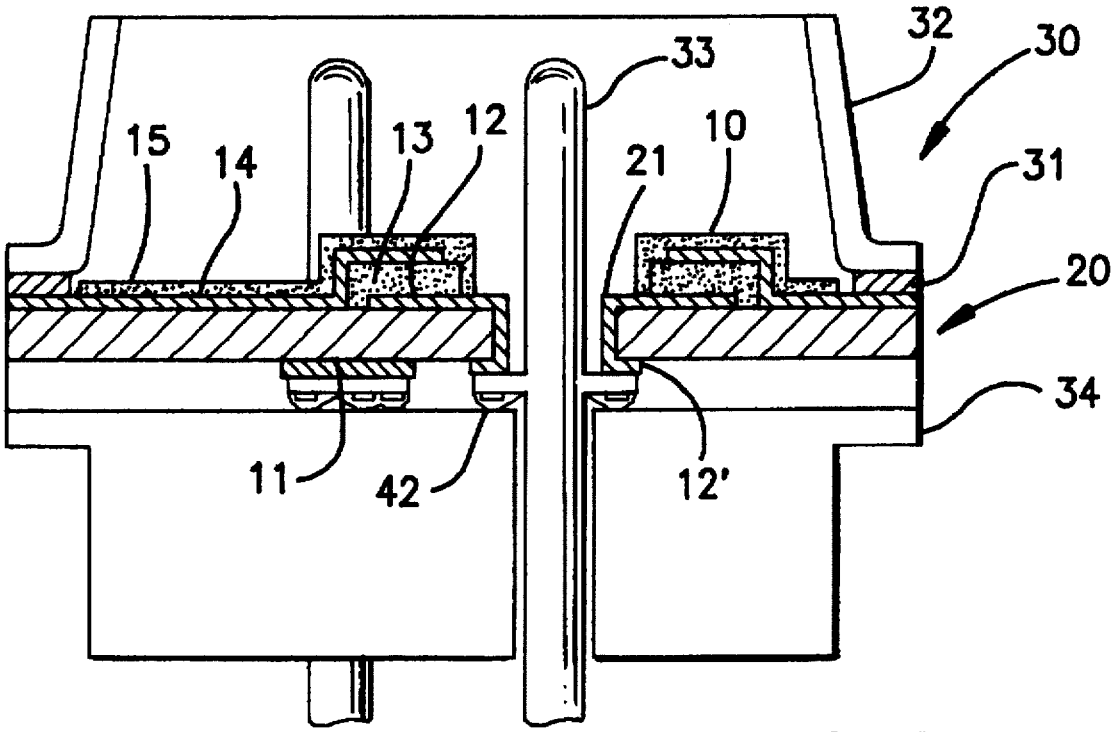
FIG. 7 is a sectional view taken along line VII—VII of FIG. 6 and viewed in a direction as indicated by arrows.
Figure 8A:
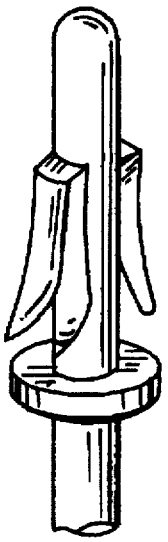
FIGS. 8(A) to 8(C) are perspective views showing various contact elements equipped with a stopper.
Figure 8B:
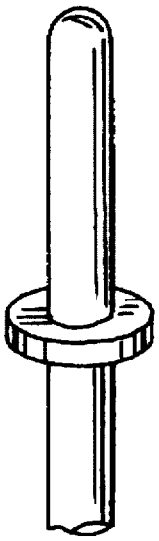
Figure 8C:
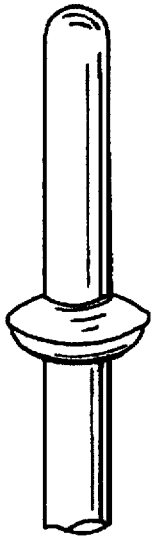

FIG. 4 is a perspective view showing a preferred embodiment of the electrical connector with a filter according to the second invention, FIG. 5 is an exploded perspective view of the electrical connector with a filter shown in FIG. 4, FIG. 6 is an exploded perspective view showing another preferred embodiment of the electrical connector with a filter according to the second invention, FIG. 7 is a sectional view taken along line VII—VII of FIG. 6 and viewed in a direction as indicated by arrows, and FIGS. 8(A) to 8(C) are perspective views showing various contact elements with a stopper.

In the following description, the same features as those described in the first invention with reference to FIGS. 1 to 3 are not described in detail, and the description as to FIG. 1 to 3 are appropriately applied to the same features of the second invention. Also, members shown in FIGS. 4 to 8, which are identical with those in FIGS. 1 to 3, are denoted by the identical reference numerals.

As shown in FIGS. 4 to 7, the electrical connector with a filter according to the second invention comprises a shield frame 32, a filter unit 20 having holes 21, contact elements 33 to be inserted respectively into the holes 21 and each having a stopper 62, a fixture 42 for allowing the contact elements 33 to be inserted, a leaf spring 31 interposed between the shield frame 32 and the filter unit 20, and a body 34. The shield frame 32, the leaf spring 31, the filter unit 20, the contact elements 33, the fixture 42, and the body 34 are assembled together and secured to one another by set pins 35.

Similar to the first invention, the leaf spring 31 is so contoured as to contact with the ground electrode 14 of the filter unit 20 and the shield frame 32, thereby electrically connecting the ground electrode 14 with the shield frame 32. The leaf spring 31 is interposed between the filter unit 20 and the shield frame 32 so as to mechanically secure and hold the filter unit 20, the shield frame 32 and the body 34.

The contact elements 33 are inserted into the respective holes 21 from the bottom surface of the filter unit 20. The contact elements 33 are inserted into the fixture 42 from the lower portion of the contact element 33, and then the fixture 42 is interposed between the filter unit 20 and the body 34. The body 34 preferably accommodates the filter unit 20. The contact elements 33 are pressed against and secured to the filter unit by the fixture 42 through the stoppers 62.

As for the filter unit 20, the filter function 10 and the ground electrode 14, the detailed description made with respect to the first invention is also appropriately applied to the second invention.

For assembling the electrical connector with a filter according to the second invention, for example, the shield frame 32, the leaf spring 31, the filter unit 20, the contact elements 33, the fixture 42, and the body 34 are assembled together in this order and secured to one another by the set pins 35. This order of assembly enables the electrical connector with a filter to be manufactured with no soldering step. It should be noted, however, that the order of assembly is not particularly limited because the order is varied according to the contour of the connector.

As for the leaf spring 31, the detailed description made with respect to the first invention is also appropriately applied to the second invention.

The fixture 42 mechanically holds the contact elements 33. Also, in particular, where the filter function 10 comprises a conductor and a dielectric substance, the fixture 42 electrically connects the electrode composed of the conductor to the contact element 33. The fixture 42 is not particularly limited in material, contour, etc. For example, the fixture is preferably a washer, a spring or a rubber. In FIGS. 4 and 5, a rubber is used as the fixture 42, whereas in FIGS. 6 and 7, a washer is used as the fixture 42.

The stopper 62 of each contact element 33 is not particularly limited in contour. It may take any contour as far as it can press the contact element 33 against the filter unit 20 in cooperation with the fixture 42. For example, contact elements as shown in FIGS. 8(A) to 8(C) are preferably used.

In the electrical connector with a filter 30 thus assembled, since the shield frame 32 and the filter unit 20 are not soldered and the contact elements 33 and the filter unit 20 are not soldered, no cracks occur, which would otherwise occur by heat produced during soldering. In addition, no solder leach occurs at all, no residue of flux for soldering is remained at all, and the connector is more resistant to temperature cycle.

Examples of the electrical connector with a filter according to the present invention will be described hereinafter. It should be noted, however, that the electrical connector with a filter according to the present invention is not limited to such examples.

[EXAMPLE 1]

The electrical connector with a filter shown in FIGS. 1 and 2 was made.

First, an Ag—Pd conductive paste was screen-printed on both surfaces of the alumina substrate 11 having the holes 21 and on the inner wall surfaces of the holes 21 in a pattern as serving as individual electrodes of the filter function 10 and dried, followed by firing for ten minutes at 850° C. to form the lower electrodes 12, 12'. Then, a dielectric paste predominantly comprises $Pb(Mg_{1/3}Nb_{2/3})O_3$ and $Pb(Zn_{1/3}Nb_{2/3})O_3$ was screen-printed in such a manner as to have an overlaid portion on the lower electrode 12, and dried. The dielectric paste may be screen-printed once or a plurality of times. In this Example, the screen-printing and drying were carried out three times, followed by firing for ten minutes at a peak temperature of 900° C. to form the dielectric layer 13. Further, an Ag—Pd conductive paste was screen-printed in such a manner as to overlay on the dielectric layer and not to contact directly the lower electrode 12 and dried, followed by firing for ten minutes at 900° C. to form the upper electrode 14. Further, an over-coating glass paste was screen-printed on the area of the lower electrode exposed to the surface and the area other than longitudinal opposite end portions of the upper electrode and dried, followed by firing for ten minutes at 530° C. to form the protective glass layer 15. In this manner, the filter unit 20 was made.

Then, the contact elements were inserted respectively into the holes 21 of the filter unit 20 and pre-heated to about 180° C. Thereafter, the contact elements 33 were soldered and secured to the filter unit 20 from both surfaces thereof by the solder 22 and electrically connected to the lower electrodes 12, 12'. Then, the flux was removed by means of ultrasonic cleaning.

Subsequently, the leaf spring 31 was inserted between the filter unit 20 having the contact elements 33 secured thereto and the shield frame 32, and secured to one another by the set pins 35 together with the body 34. In this manner, the electrical connector with a filter 30 was made. The leaf spring 31 electrically connects the upper electrode 14 to the shield frame 32, and as a result the upper electrode 14 served as an ground electrode and functioned to enhance the electromagnetic shielding effect together with the shield frame 32. That is, the electrical connector with a filter of this Example exhibits a high noise attenuation effect. Further, since the contact elements 33 are soldered at both surfaces of the filter unit 20, securing strength is very strong and reliability is high.

[EXAMPLE 2]

The electrical connector with a filter shown in FIG. 3 was made.

First, a ferrite paste was screen printed on the inner wall surface of each hole 21 of the alumina substrate 11 having the holes 21 and dried, followed by firing for ten minutes at 900° C. to form the ferrite layer 56. Then, an Ag—Pd conductive paste was screen-printed on a single surface of the alumina substrate 11 and dried, followed by firing for ten minutes at 850° C. to form the lower electrode 12. Subsequently, the dielectric layer 13, the upper electrode 14 and the protective glass layer 15 were formed in the substantially same manner as in Example 1. In this manner, the filter unit 20 was made.

Then, the contact elements 33 were inserted respectively into the holes 21 of the filter unit 20 and pre-heated to about 180° C. Thereafter, the contact elements 33 were secured to the filter unit 20 by soldering from one side surface thereof, and electrically connected to the lower electrode 12. Then, the flux was removed by ultrasonic cleaning.

Subsequently, the leaf spring 31 was inserted between the filter unit 20 and the shield frame 32 in the substantially same manner as in the Example 1 and secured to one another by the set pins 35 together with the body 34. In this manner, the electrical connector with a filter 30 was made. The leaf spring 31 electrically connects the upper electrode 14 to the shield frame 32, and as a result the upper electrode 14 served as a ground electrode and functioned to enhance the electromagnetic shielding effect together with the shield frame 32. That is, the electrical connector with a filter of this Example exhibits a high noise attenuation effect.

[EXAMPLE 3]

The electrical connector with a filter shown in FIGS. 4 and 5 was made.

First, the filter unit 20 having the filter function 10 and the ground electrode was made in accordance with the substantially same manner as in the Example 1.

Then, the contact elements 33 each having a stopper 62 were inserted respectively into the holes 21 from the bottom surface of the filter unit 20 (from the side where the filter function is not formed) and the rubber 42, which serves as a fixture, having contact element insertion holes was provided on the bottom surface of the filter unit 10 in such a manner that the contact elements 33 penetrate the insertion holes of the rubber 42. Subsequently, the shield frame 32, the leaf spring 31, the filter unit 20 and the body 34 were assembled in this order and secured to one another by the set pins 35. In this manner, the electrical connector with a filter without any application of solder was made.

In the electrical connector with a filter thus manufactured, the upper electrode 14 of the filter function 10 functioning as a ground electrode and the shield frame 32 are electrically connected by the leaf spring 31. Also, the contact elements 33 pressed against the filter unit 20 by the rubber 42 through the stoppers 62 are electrically connected to the lower electrode of the filter function 10. As a result, the electrical connector with a filter of this embodiment exhibits a high electromagnetic shielding effect and a high noise attenuation effect. Moreover, since the connector is manufactured by a simplified assembling process comprising no soldering steps, the connector has advantages that no cracks occurs, no residue of flux remains, and the connector is resistant to temperature cycle and has a high reliability.

[EXAMPLE 4]

The electrical connector with a filter shown in FIGS. 6 and 7 was made.

First, the filter unit 20 having the filter function 10 and the ground electrode was made in accordance with the substantially same manner as in the Example 1.

Then, the contact elements 33 each having a stopper 62 were inserted respectively into the holes 21 from the bottom surface of the filter unit 20 (from the side where the filter function is not formed) and the washers 42 serving as fixtures were provided on the bottom surface of the filter unit 20 in such a manner that the contact elements 33 penetrate the washers 42. Subsequently, the shield frame 32, the leaf spring 31, the filter unit 20 and the body 34 were assembled in this order and secured to one another by the set pins 35. In this manner, the electrical connector with a filter without any application of solder was made.

In the electrical connector with a filter thus manufactured, the upper electrode 14 of the filter function 10 functioning as a ground electrode and the shield frame 32 are electrically connected by the leaf spring 31. Also, the contact elements 33 pressed against the filter unit 20 by the washers 42 through the stoppers 62 are electrically connected to the lower electrode of the filter function 10. As a result, the electrical connector with a filter of this Example exhibits a high electromagnetic shielding effect and a high noise attenuation effect. Moreover, since the connector of this Example is manufactured in a simplified assembling process comprising no soldering step, the connector has advantages that no cracks occurs, no residue of flux remains, and the connector is resistant to temperature cycle and has high reliability.

[EXAMPLE 5]

An electrical connector with a filter was made in accordance with the substantially same manner as in the Example 4 except for employing springs in place of the washers 42 as fixtures. The same results as in the Example 4 were obtained.

Although the present invention has been described in accordance with the preferred embodiments, they are employed merely to help the understanding of the present invention, and therefore various variations and modifications can be made without departing from the scope of the present invention.

Industrial Applicability

The electrical connector with a filter according to the present invention not only exhibits a high electromagnetic shielding effect but also a high attenuation effect for attenuating unnecessary frequencies of the electromagnetic signal. Moreover, since the filter unit and the shield frame are not secured by soldering, cracks may not occur. Moreover, the connector is resistant to temperature cycle and has high reliability. Particularly, in the electrical connector with a filter according to the first invention, electrical connection and mechanical holding can be realized simply by assembling the shield frame, the leaf spring and the filter unit (and the body, where necessary) and secured by set pins. Thus, the process can be simplified. In the electrical connector with a filter according to the second invention, since the assembling process comprises no soldering step, the press can be more simplified, and no cracks occurs and no residue of flux remains. Moreover, the connector becomes more resistant to temperature cycle and has a higher reliability.

I claim:

1. An electrical connector comprising a shield frame, a filter unit having holes, contact elements to be inserted respectively into said holes, and a leaf spring interposed between said shield frame and said filter unit, said leaf spring comprising at least one of a convex and a concave portion to create at least one shield frame contact portion and at least one filter unit contact portion, a remaining portion of said leaf spring being substantially planar, said filter unit having a filter element corresponding to respective ones of said holes, and a ground electrode;

said filter element comprising a conductor and a dielectric substance and/or ferrite, which are formed on an alumina substrate by the thick-film printing technique;

said filter unit allowing said contact elements to be retained and secured therein;

said ground electrode and said shield frame being electrically connected by said leaf spring being electrically conductive; and said filter unit and said shield frame being mechanically secured and held by said leaf spring.

2. The electrical connector according to claim 1, further comprising a body, and said shield frame, said filter unit, said leaf spring and said body being secured to one another.

3. The electrical connector according to claim 1, wherein said dielectric substance comprises at least two compounds selected from the group consisting of $Pb(Mg_{1/3}Nb_{2/3})O_3$, $pb(Zn_{1/3}Nb_{2/3})O_3$ and $PbTiO_3$.

* * * * *